United States Patent [19]

Ryan

[11] 3,938,688

[45] Feb. 17, 1976

[54] COVERED SERVING TRAY

[75] Inventor: Jay Edward Ryan, Wheeling, Ill.

[73] Assignee: American Hospital Supply Corporation, Evanston, Ill.

[22] Filed: Jan. 7, 1974

[21] Appl. No.: 431,152

[52] U.S. Cl. ..... 220/23.8; 206/541; 206/545; 220/20; 220/94 A

[51] Int. Cl.[2] ..... B65D 1/36; A45C 11/20

[58] Field of Search ..... 220/23.6, 23.8, 23.83, 220/23.86, 4 B, 4 E, 42 A, 42 B, 42 C, 60 R, 20, 94 A; 206/4, 379, 541, 545

[56] References Cited

UNITED STATES PATENTS

| | | | |
|---|---|---|---|
| 2,513,894 | 7/1950 | Rogers | 206/379 |
| 3,016,129 | 1/1962 | King | 206/4 |
| 3,103,278 | 9/1963 | Kuzma | 220/9 F |
| 3,532,247 | 10/1970 | Bridges | 206/4 |
| 3,754,640 | 8/1973 | Bridges | 220/23.8 |
| 3,799,143 | 3/1974 | Bridges | 206/4 |

*Primary Examiner*—George E. Lowrance
*Attorney, Agent, or Firm*—Dawson, Tilton, Fallon & Lungmus

[57] ABSTRACT

A tray assembly for the delivery and service of foods, such assembly including base and cover sections having a plurality of opposing recesses for enclosing a number of dishes, cups, and other utensils needed for a complete meal service. Proper vertical alignment of the two sections as they are fitted together is facilitated by corresponding lateral indentations in the side walls of both parts which serve in manual guiding of the cover into position upon the base, and by arcuate shoulders spaced circumferentially about a generally central recess in one of the sections, such shoulders being received in a complementary channel in the other section. Lugs disposed within the channel are received in notches between the arcuate shoulders only when the cover and base sections are in precise rotational alignment. Should slight misalignment occur as the parts are being fitted together, the configuration and dimensions of the vessel-receiving recesses tend to re-orient the vessels without danger of spilling their contents.

9 Claims, 8 Drawing Figures

12
12a
12b
12c
12d
12e
11
11a
11b
11c
11d
11e
20
20a
20b
21
21a
21b
16
16a
24
29
29a
33
34
35
36

COVERED SERVING TRAY

Background

While insulated trays have been known in the past, such assemblies have for the most part consisted of insulated base and cover sections designed to hold a single plate or dish of food (Clarke patent Des. 158,050; Barron et al U.S. Pat. Des. 191,124; Clarke U.S. Pat. No. 3,019,783). Insulated trays have also been developed to hold the dishes and utensils for a complete meal service, such trays being constructed so that the base section of one unit provides the insulated cover for another unit in the same stack (Innis U.S. Pat. No. 3,122,265; Bridges U.S. Pat. No. 3,532,247). Such latter arrangement is only partially effective since it lacks flexibility, requiring the trays to be dispensed in a pre-set sequence from the top of the stack and making last-minute adjustments in the order of service awkward and difficult.

Co-pending co-owned application Ser. No. 213,987, filed Dec. 30, 1971, now U.S. Pat. No. 3,799,386, discloses an insulated serving tray with recesses for supporting the dishes and other utensils for a complete meal service. An insulated cover extends over the entire tray and its contents. While such an arrangement overcomes many of the shortcomings of prior constructions, difficulty is sometimes encountered in properly positioning the relatively large insulated cover upon the base or tray section, particularly because the cover tends to block a user's view of the tray as the cover is lowered into position. Should the sections be laterally misaligned, or should the cover be twisted or turned relative to the base as it is lowered, there is a danger that foods and food-containing vessels supported by the base will be engaged by partitions of the cover, thereby possibly displacing the contents of the tray and causing tipping and spilling of the beverage-containing vessels. While the problem might be reduced by enlarging the base section so that it remains visible at all times as the cover is lowered, such a construction would be clearly undesirable because of the increased size and bulk of the combination as a whole. Reducing the size of the cover is not an acceptable solution because of the main objective of providing a cover which encloses and insulates all of the items supported by the tray and any reduction in cover size would therefore compromise that objective.

SUMMARY

The present invention is concerned with an insulated tray assembly which overcomes or greatly reduces the aforementioned problems associated with prior constructions. While the insulated two-piece serving tray is particularly suitable for use in hospitals, nursing homes, and other institutions, it will be apparent from the following description that the assembly might also be used in other places where meals of hot and/or cold foods must be transported a substantial distance to the recipient, or where the interval of delivery is long enough to otherwise present a problem in maintaining the meals in serving condition.

The combination includes an insulated base or tray section having a plurality of recesses for supporting a number of separate dishes, cups, and the like. One of the recesses of the tray section is generally centrally located and is sized to receive the main entree dish for the meal service. The cover section is provided with a plurality of downwardly-facing recesses which complement the recesses of the tray and which include an enlarged centrally located recess overlying the central recess of the tray. One of the sections, preferably the tray section, is provided with a channel extending perimetrically about the central recess and the other section (cover) is provided with a plurality of depending arcuate circumferentially-spaced shoulders receivable in that channel. Within the channel are a plurality of integral lugs which are positioned and arranged to be received in the spaces between the ends of the arcuate shoulders as the cover and base sections are fitted together.

The planar dimensions of the cover section correspond with those of the base section. Despite the size of the cover and its tendency to block a view of the base as the cover is lowered into position, proper alignment of the parts is nevertheless readily achieved, partly because of vertical recesses or indentations formed in the opposite side walls of the respective sections. Such indentations register with each other when the two sections are vertically aligned. The indentations are of a width sufficient to accommodate fingers of a user's hand and, in general, such width approximates the width of an adult hand. Thus, the indented portions of the respective sections constitute guide means for manually guiding the cover into proper position upon the base. Since such guiding action is accomplished largely by touch rather than by sight, the fact that a user's view of the base section may be obstructed by the cover as it is being lowered does not reduce the ease with which the parts may be properly fitted together.

Positive alignment occurs when the cover has been lowered to the point where the arcuate ribs or shoulders of the cover section enter the circumferential channel of the base section. The interfit between the shoulders and channel insure that the dome-shaped central recess of the cover is directly over the circular central recess of the base. Precise rotational alignment occurs as the lugs within the channel are received in the spaces between the ends of the arcuate shoulders.

The interfitting channel, shoulders and lugs also serve the important function of maintaining the sections in proper relation and preventing inadvertent lateral or rotational displacement of the cover during transport of the assembly. If such relative movement of the cover were possible, then it is believed apparent that beverage containers supported by the tray might easily become tipped and, in general, the contents of the respective recesses might be spilled or intermixed. The interlocking relation of the shoulders, lugs, and channel eliminates or at least greatly reduces that danger and, of particular significance, does so without the need for overlapping flanges extending about the full perimeter of the tray and/or cover. Thus, when viewed in plan, the tray and cover are of essentially the same dimensions and the tray section has a flat smooth upper surface except, of course, for the dish and utensil receiving recesses provided therein.

Other advantages and objects of the invention will become apparent as the specification proceeds.

DRAWINGS

DESCRIPTION

Figure 1:
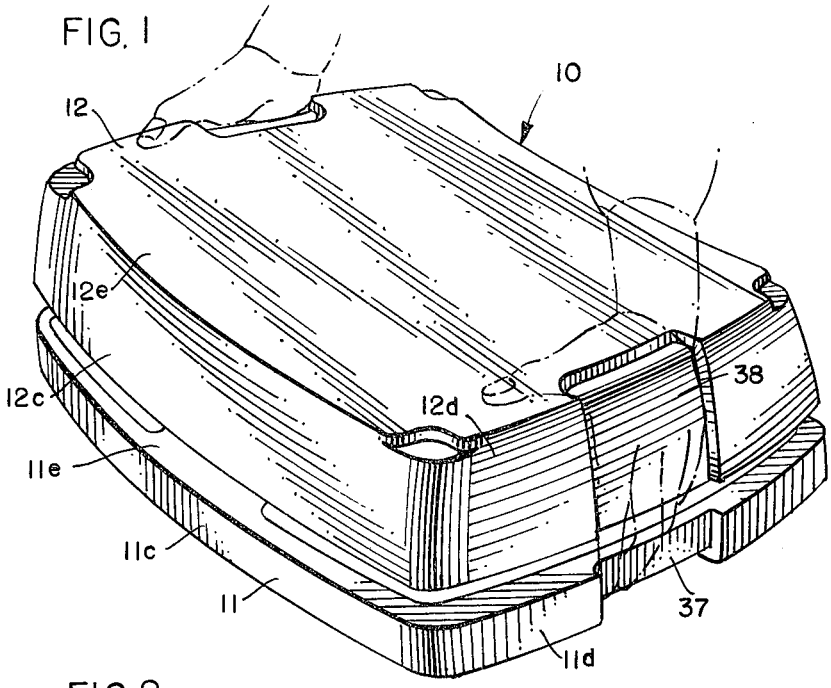
FIG. 1 is a perspective view of a covered serving tray embodying the present invention, the structure being illustrated as the cover is being lowered in place upon the tray.

Referring to the drawings, numeral 10 generally designates a covered tray assembly which includes a tray or base section 11 and a top or cover section 12. Each section is composed of a plastic shell filled with a suitable insulating material, preferably a rigid plastic foam. For clarity of illustration, the space within each shell is shown to be empty in FIGS. 5–7; however, it is to be understood that polyurethane foam or some other suitable insulating material would be injected or incorporated in each shell in the finished product. The shells of the respective sections may be formed of polystyrene, polycarbonate, or any other suitable plastic material capable of withstanding heat, cold, and the various chemical agents found in foods and in the cleaning of food-handling equipment.

Figure 2:
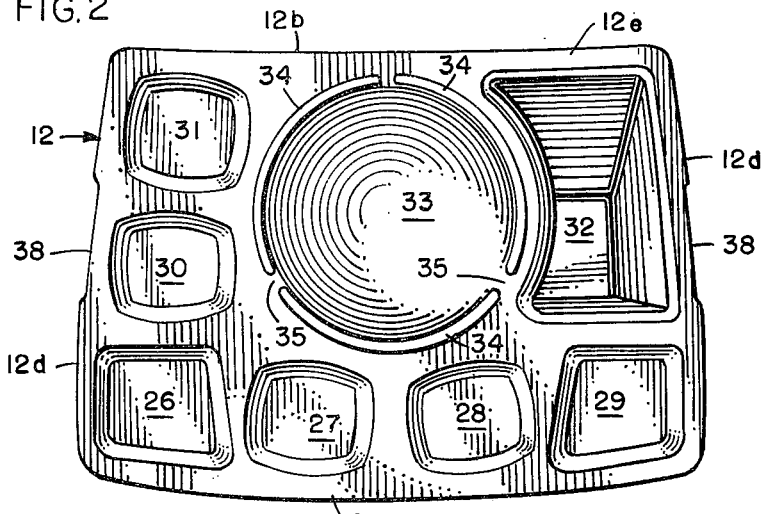
FIG. 2 is a bottom view of the cover section illustrating the recesses or cavities therein.

The base or tray section 11 includes bottom wall 11*a*, front wall 11*b*, rear wall 11*c*, side walls 11*d*, and top wall 11*e*. All of the walls may be integrally formed by suitable molding techniques known in the art or, if desired, certain of the walls may be formed separately and thereafter joined or fused with the remaining structure to form the complete base shell shown in the drawings. Similarly, cover section 12 comprises a bottom wall 12*a*, front wall 12*b*, rear wall 12*c*, side walls 12*d*, and top wall 12*e*. The two sections are of substantially the same planar dimensions, as clearly illustrated in FIGS. 2, 3, and 7 and, when viewed in plan, are generally rectangular in appearance. In the preferred form illustrated, the elongated front and rear walls of the respective sections have a slight curvature, as do the side walls, so that the entire assembly is slightly arcuate or fan-shaped (FIG. 1). It is to be understood, however, that if desired each of the components may be precisely rectangular in configuration or, alternatively, may have even greater curvature.

Because of the complex configuration, the top wall 11*e* of the tray may be regarded as an essentially planar body portion having deformations which define a plurality of upwardly-opening recesses for receiving dishes, cups, and the like. One such arrangement of recesses 13–20 is illustrated in the drawings; however, such arrangement may be varied considerably depending on the type of food service for which the tray is to be utilized. In the illustration given, recesses or cavities 14, 15, 17 and 18 are shaped to receive a relatively small dish of standardized dimensions, such dish being generally designated by the numeral 21 in FIG. 4 and also being shown with a removable cover 22. Corner recesses 13 and 16 are designed to receive beverage servers of any of a variety of types, two forms 23 and 24 being represented in FIG. 4. It is to be noted that the bottom surface 13*a* and 16*a* of each cavity 13 and 16 is smooth and flat, and that each cavity has lateral dimensions considerably larger than the vessel to be supported therein (FIG. 5). Thus, the liquid-carrying vessel, whether it be a cup, tumbler, pitcher, or bowl, is supported on the flat surface (such as surface 26*a*) so that a limited amount of lateral sliding movement of the vessel within the cavity (such as recess 16) is possible.

Recess 19 is dimensioned to hold items such as flatware, napkins, menu cards, and the like. It will be recognized that the tray as illustrated is suitable for the service of meals of various types and that the contents or utilization of each recess will vary considerably depending on the particular meal service involved.

Figure 3:
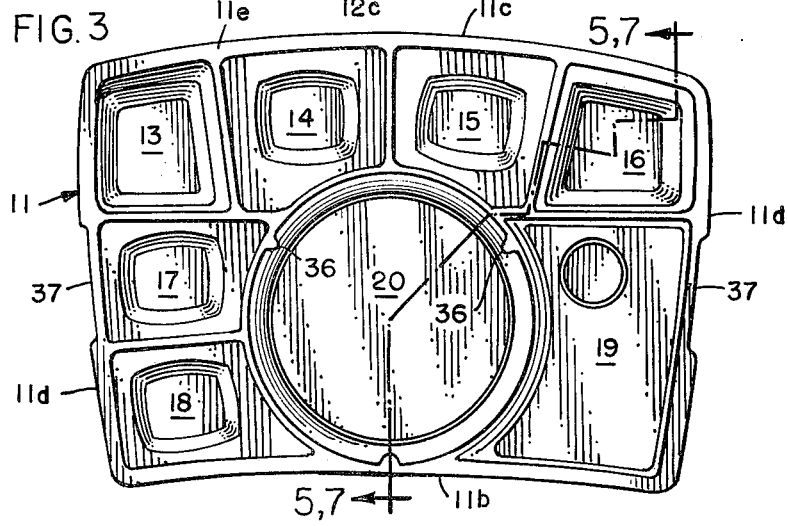
FIG. 3 is a top plan view of the base or tray section.
Figure 4:
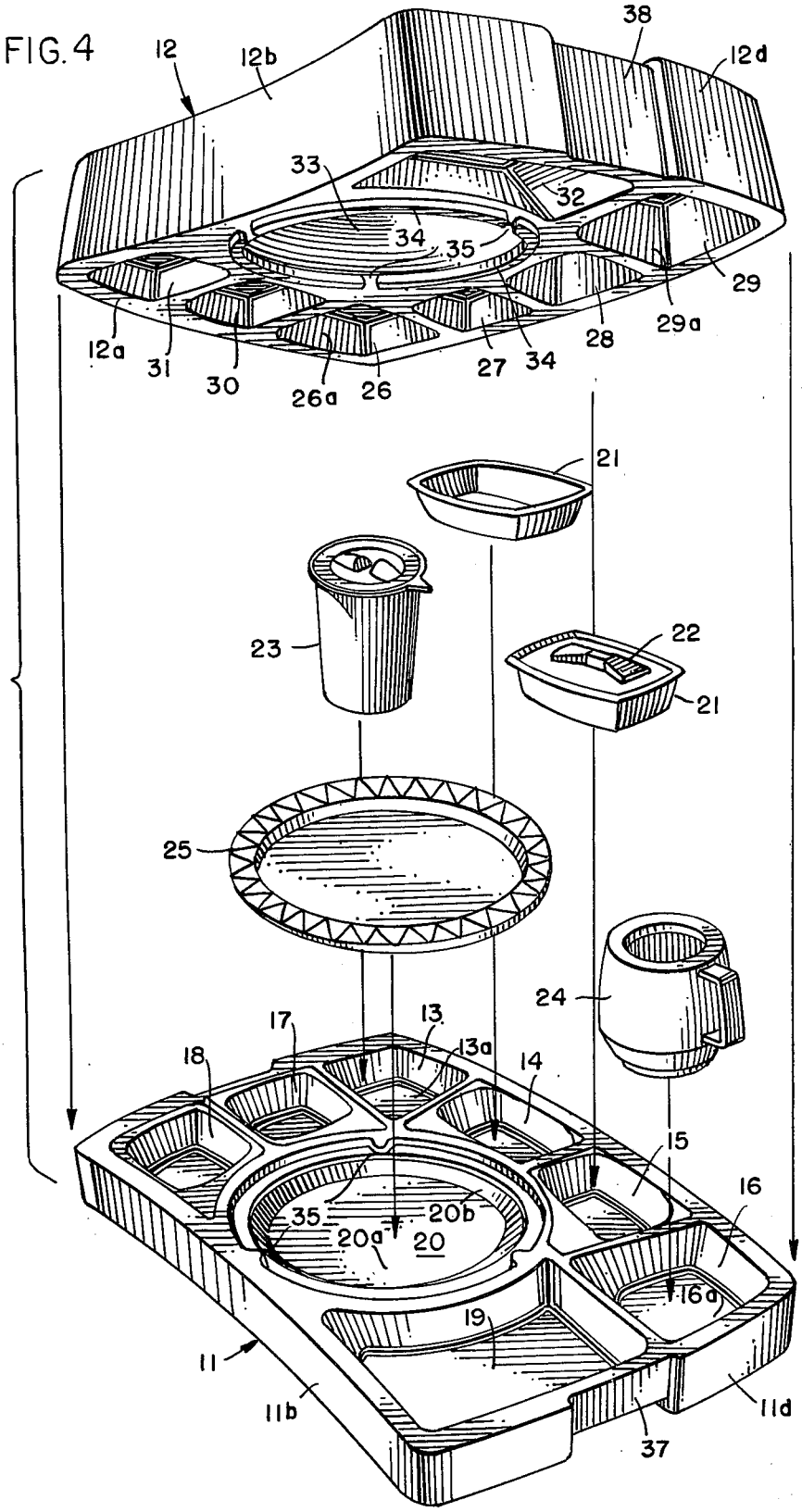
FIG. 4 is an exploded perspective view illustrating the assembly and showing certain representative dishes and other vessels adapted to be received therein.
Figures 5, 6, 7, 8:
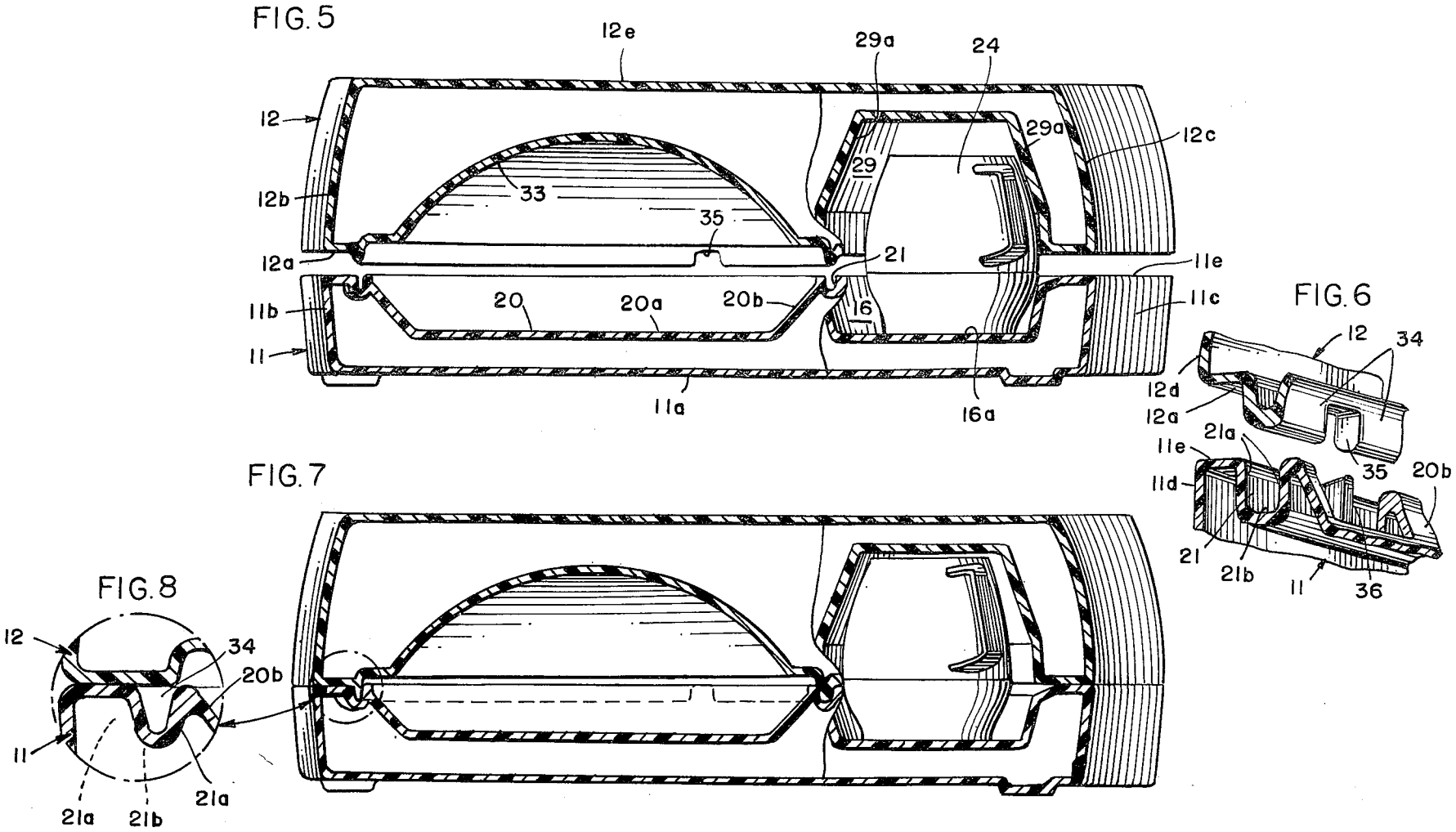
FIG. 5 is a sectional side view taken along line 5—5 of FIG. 3 and showing the parts in slightly separated condition.
FIG. 6 is an enlarged fragmentary perspective view showing the channel, shoulders and lug when the base and cover sections are spaced slightly apart but in general vertical alignment.
FIG. 7 is a sectional view taken along line 7—7 of FIG. 3, the view being similar to FIG. 5 except that the cover and base sections are shown in fully interfitted relation.
FIG. 8 is an enlarged detail view of the structure encircled in FIG. 7.

The main recess 20 is generally circular in configuration and, as shown most clearly in FIGS. 3 and 4, is centrally located, spaced substantially equidistant from the side walls 11*d* of the tray. The main recess or cavity has a generally flat bottom surface 20*a* and an upwardly sloping side wall 20*b* for receiving and supporting an entree plate or dish 25 (FIG. 4) which may be formed either of china or other rigid material capable of withstanding repeated use, or of thin plastic or paper suitable for destruction by incineration, or by some other suitable process, after a single use.

Recess 20 is surrounded by a perimetric channel as shown most clearly in FIGS. 4, 5, and 6. The channel is generally circular in outline and is U-shaped in cross sectional configuration, as defined by spaced side walls 21*a* bridged by an arcuate bottom wall 21*b* (FIG. 6). The upper limits of the channel lie in substantially the same plane as the top surface 11*e* of the tray.

The bottom 12*a* of cover section 12 is similarly of complex configuration and may be regarded as a generally planar body portion having a plurality of upwardly extending (and downwardly opening) recesses 26–33 positioned and arranged so that when the parts are assembled cover recesses 26–33 overlie and complement the corresponding recesses 13–20 of the base. Thus, cover recesses 26 and 29 are disposed directly above corner recesses 13 and 16, respectively, when the cover is in place upon the tray or base. It will be noted that the corner recesses 26 and 29 of the cover have transverse dimensions at their open lower ends which correspond closely to the transverse dimensions of the tray recesses directly therebelow but that the side walls 26*a* and 29*a* of those cover recesses slope upwardly and inwardly at an angle measured from the vertical within the range of approximately 5° to 20°, the preferred range being 8° to 10°. The main central recess 33 of the cover is of dome-shaped configuration with the lower peripheral limits of the dome disposed within the outermost limits of base recess 20 so that condensation forming on the dome from moisture-laden vapors rising from hot food supported by the entree plate will be returned to the plate to maintain the food in moist and flavorful condition.

Surrounding the dome-shaped central recess 33 of the cover are a plurality of arcuate shoulders or ribs 34, such ribs projecting downwardly a limited distance from the planar undersurface 12*a* of the cover and being positioned and arranged to fit within the circumferential channel 21 of the base. As clearly illustrated in FIGS. 2, 4 and 6, the ends of the shoulders or ribs are circumferentially spaced to define notches or openings 35 therebetween. Such notches are dimensioned and arranged to receive a plurality of circumferentially-spaced lugs 36 formed in base section 11 and projecting radially inwardly into channel 21. It will be noted that the lug portions do not completely span or traverse the channel, with the result that condensate which does collect in the channel will tend to be equally distributed throughout the channel to assist in forming a moisture or liquid seal between the nested parts.

Referring to FIGS. 1 and 4, it will be seen that the side walls 11*d* and 12*d* of the tray and cover sections are provided with inwardly and vertically extending indentations 37 and 38, respectively. The indentations extend the full height of each wall and are of a width approximating, or slightly greater than, the width of an average adult hand. In general, the width of each recess should fall within the range of 3 to 5 inches, the optimum width being approximately 4 inches. Of particular importance is the fact that the cover and base indentations on each side of the assembly are disposed in vertical alignment when the cover is in place on the base. As shown in FIG. 1, the combined height of the tray and cover sections is substantially less than the span of an average adult hand.

The vertically-alignable side indentations serve as a guide means for use in manually guiding the cover section into position upon the base. The indentations serve as handles for receiving a user's hands in the manner generally indicated in FIG. 1 and, through tactile perception, the user may readily guide the cover into lowered position even when view of the base section is blocked. Since the width of the indentations corresponds generally to the width of the user's hands (as measured across four fingers excluding the thumb), a user may readily detect by feel, and without visual observation, when the indentations of the cover and base are in direct vertical alignment.

As the cover is thus lowered into position, the arcuate ribs or shoulders 34 enter channel 21, thereby insuring precise vertical alignment of the parts. Lugs 36 will not enter notches 35 unless the cover and base are also in precise rotational alignment; thus, the lugs, shoulders, and channel all cooperate to insure that the parts nest properly together.

During transport and handling, it is possible that lateral forces may be exerted upon the cover (or the base) which would tend to shift the parts out of vertical alignment, or rotational alignment (about an axis extending vertically through central recesses 20 and 33) if it were not for the interlocking relation between the arcuate shoulders, lugs, and channel. To displace the cover laterally, or to rotate it relative to the base, it must first be lifted a distance sufficient to withdraw the arcuate shoulders from the channel and, since such a sequence or combination of forces would not be expected to occur by accident or through inadvertence during normal handling of the covered tray assembly, the danger of spilling or intermixing the contents of the tray through accidental displacement of the cover during normal handling is virtually non-existent. Such advantages are achieved while at the same time providing a tray having smooth planar top surfaces adjoining each of its upstanding outer walls.

Should the cover be slightly out of alignment with the base as it is being lowered into position, engagement between the sloping side walls 26*a* or 29*a* of cover recesses 26 and 29 with the fluid-containing vessel 23 or 24 supported by the base has the effect of camming or urging such a vessel laterally upon the flat smooth surfaces 13*a* or 16*a*. In other words, the vessels are urged laterally by the sloping surfaces of the cover rather than being urged into a tipped condition which might cause their contents to spill.

While in the foregoing an embodiment of the invention has been disclosed in considerable detail for purposes of illustration, it will be understood by those skilled in the art that many of these details may be varied without departing from the spirit and scope of the invention.

I claim:

1. A food server combination comprising separable tray and cover sections; said tray and cover sections each having planar body portions and having front, rear, and side walls; said planar body portion of said tray section having a plurality of upwardly-opening recesses for receiving dishes, cups, and the like; one of said recesses being generally centrally disposed intermediate the side walls of said tray section; said planar body portion of said cover section having a plurality of downwardly-opening recesses complementing the recesses of said tray section and including a generally central recess overlying the central recess of said tray section; one of said sections providing a channel extending perimetrically about the central recess thereof and the other of said sections providing a plurality of arcuate circumferentially-spaced shoulders received within said channel; said one section also including a plurality of lug portions in said channel received in the spaces between said circumferentially-spaced shoulders and engagable with the ends of said shoulders for locking said cover and tray sections against relative rotation in planes parallel with said planar body portions.

2. The combination of claim 1 in which said shoulders are provided by said cover section and said channel is provided by said tray section.

3. The combination of claim 2 in which said shoulders extend downwardly a substantial distance below the remainder of said cover section and are adapted to be received within said channel as said sections are fitted together and before other parts of said sections contact each other.

4. The combination of claim 1 in which said channel is generally circular in outline.

5. The combination of claim 1 in which the outer surfaces of said side walls of said tray and cover sections have inwardly and vertically extending indentations; said indentations of the respective sections being in vertical alignment and extending the full height of each section.

6. The combination of claim 5 in which each indentation has a width falling within the range of approximately 3 to 5 inches.

7. The combination of claim 1 in which a second of said recesses of said tray section is adapted to receive a beverage vessel; said second recess having a flat smooth bottom surface; said cover section also having a corresponding second recess overlying the second recess of said tray section; said second cover recess having an upwardly and inwardly sloping side wall engagable with a beverage vessel for urging the same laterally upon said smooth flat surface as said tray and cover sections are fitted together.

8. The combination of claim 7 in which said combination includes a beverage vessel having a bottom slidably supported upon said smooth bottom surface and having a upper portion engagable with said upwardly and inwardly sloping side wall.

9. The combination of claim 7 in which said upwardly and inwardly sloping side wall has an inclination within the range of approximately 5° to 20° measured from the vertical.

* * * * *